US008760011B2

(12) United States Patent
Liang et al.

(10) Patent No.: US 8,760,011 B2
(45) Date of Patent: Jun. 24, 2014

(54) FAN

(75) Inventors: An-Gang Liang, Shenzhen (CN); Zheng-Heng Sun, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 847 days.

(21) Appl. No.: 12/916,628

(22) Filed: Oct. 31, 2010

(65) Prior Publication Data

US 2012/0091826 A1 Apr. 19, 2012

(30) Foreign Application Priority Data

Oct. 14, 2010 (CN) ..... 2010 1 0508309

(51) Int. Cl.
*H01H 35/00* (2006.01)

(52) U.S. Cl.
USPC ..... 307/119

(58) Field of Classification Search
USPC ..... 307/119
See application file for complete search history.

(56) References Cited

U.S. PATENT DOCUMENTS

2008/0164134 A1* 7/2008 Ochiai et al. ..... 200/83 P

* cited by examiner

*Primary Examiner* — Rexford Barnie
*Assistant Examiner* — Dru Parries
(74) *Attorney, Agent, or Firm* — Novak Druce Connolly Bove + Quigg LLP

(57) ABSTRACT

A fan includes a housing, a cable, a number of blades received in and mounted to the housing, a motor driving the blades to operate and receiving electric energy by the cable, and a switch mounted on a bottom of the housing and connected with the cable. When the fan presses the switch, the cable and the switch form a closed circuit. When the fan releases pressure from the switch, the closed circuit is opened.

3 Claims, 3 Drawing Sheets

FAN

BACKGROUND

1. Technical Field

The present disclosure relates to a fan.

2. Description of Related Art

When working with servers, such as during system testing, screw-less fans are commonly used so they can be easily installed and removed as needed. However, because they are so easy to remove, users may attempt to remove a fan while it is still operating which can be dangerous.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
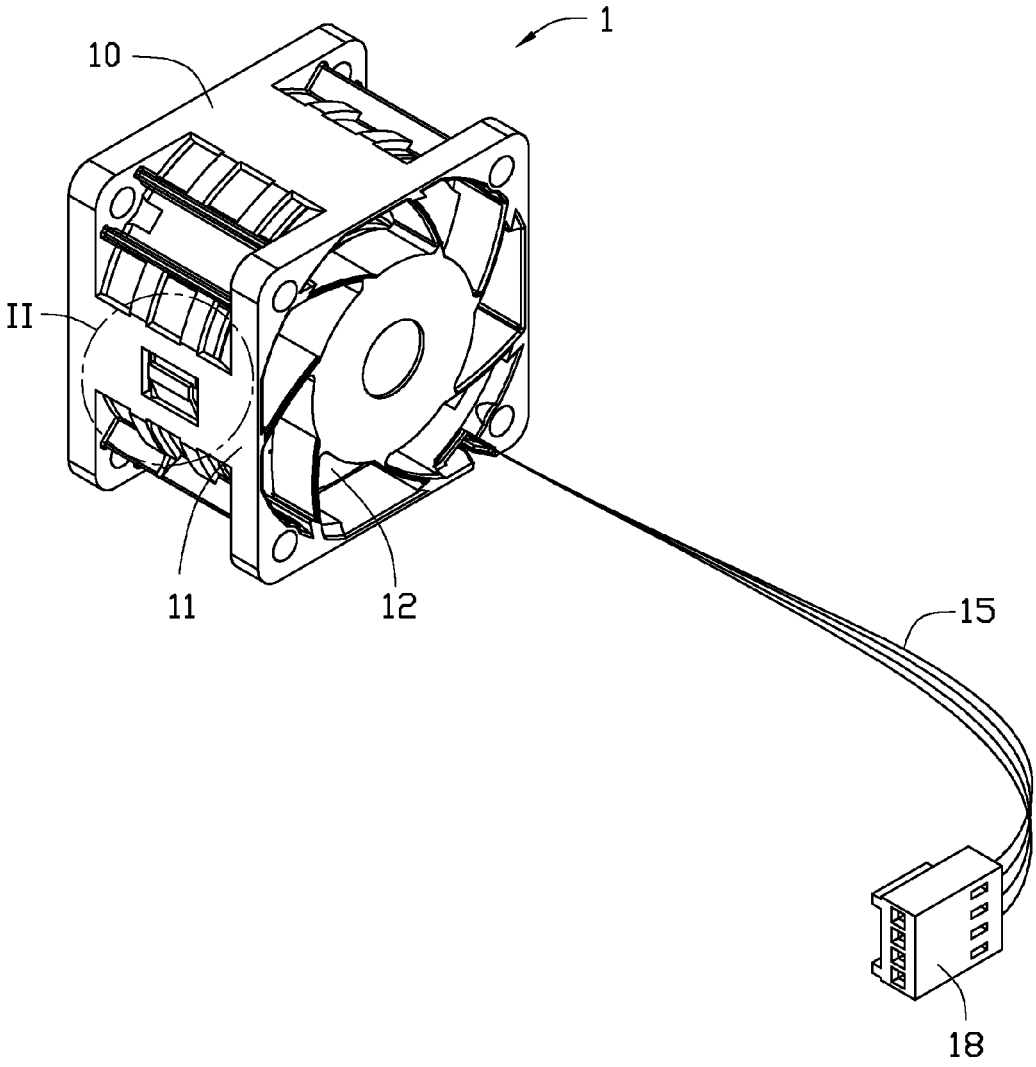
FIG. 1 is an assembled, isometric view of an exemplary embodiment of a fan.
Figure 2:
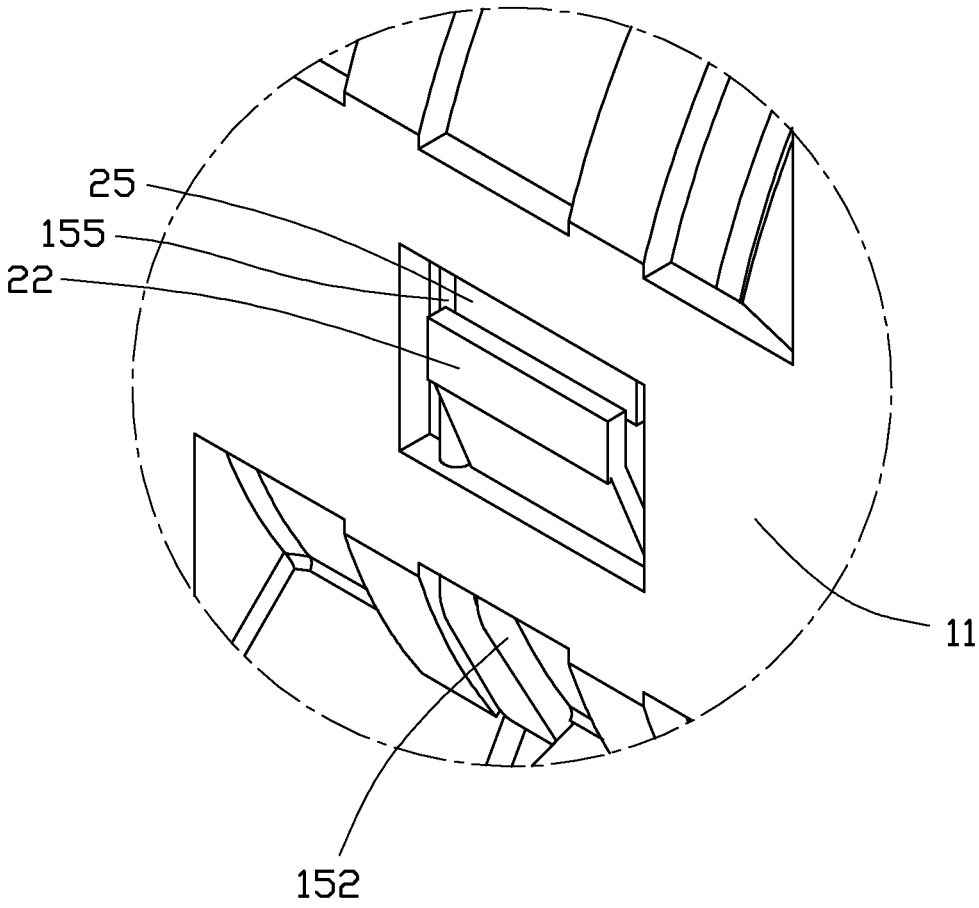
FIG. 2 is an enlarged view of the circled portion II of FIG. 1.
Figure 3:
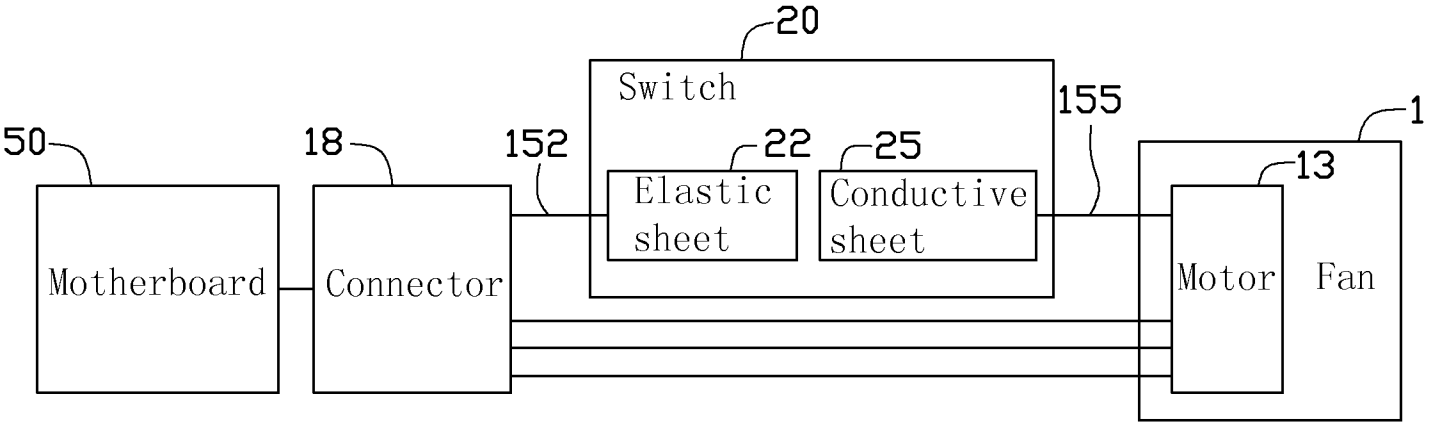
FIG. 3 is a circuit block diagram of the fan of FIG. 1 connected to a motherboard.

Referring to FIGS. 1 to 3, an exemplary embodiment of a fan 1 includes a housing 10, a number of blades 12, a motor 13, a bunch of cables 15, a connector 18, and a switch 20 mounted on a bottom 11 of the housing 10. The housing 10, the blades 12, and the motor 13 are the same as or similar those used in a common fan. The motor 13 is electrically connected to a motherboard 50 of a server (not shown) by the cables 15 and the connector 18, to receive electric energy and control signals from the server.

The switch 20 includes an elastic sheet 22 and a conductive sheet 25. The elastic sheet 22 and the conductive sheet 25 are made of electrically conductive material. One of the cables 15 includes a first conductive wire 152 and a second conductive 155. A first end of the first conductive wire 152 is connected to a first end of the elastic sheet 22, and a second end of the first conductive wire 152 is connected to the connector 18. A first end of the second conductive wire 155 is connected to a first end of the conductive sheet 25, and a second end of the second conductive wire 155 is connected to the motor 13. The second end of the elastic sheet 22 is located at an outer side of the second end of the conductive sheet 25 and opposite to the second end of the conductive sheet 25. The second end of the elastic sheet 22 is used to be deformed to be selectively connected to or separated from a second end of the conductive sheet 25.

In use, the fan 1 is received in the server. The bottom 11 of the fan 1 resists against the server. The elastic sheet 22 is pressed by the whole weight of the fan 1 to deform to be connected to the second end of the conductive sheet 25 by the second end of the elastic sheet. Thereby, the first conductive wire 152 is connected to the second conductive wire 155 to form a closed circuit. When the connector 18 is connected to the motherboard 50, it is turned on by electricity received from the motherboard 50.

When the fan 1 is taken out from the server, the elastic sheet 22 is restored.

Thus, the elastic sheet 22 is separated from the conductive sheet 25, and the first conductive wire 152 is disconnected from the second conductive wire 155. The closed circuit is opened. In this situation, even if the connector 18 is still connected to the motherboard 50, the fan 1 cannot receive electric power from the motherboard 50, so the fan 1 stops working and is safe for user to handle.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fan comprising:

a housing;

a cable;

a plurality of blades received in and mounted to the housing;

a motor driving the plurality of blades to operate and receiving electric energy by the cable; and a switch mounted on a bottom of the housing and connected with the cable;

wherein when the fan presses the switch, the cable and the switch form a closed circuit, when the fan releases pressure from the switch, the closed circuit is opened.

2. The fan of claim 1, wherein the switch comprises an elastic sheet and a conductive sheet, and the cable comprises a first conductive wire and a second conductive wire, a first end of the elastic sheet is connected to a first end of the first conductive wire, and a second end of the first conductive wire is connected to the connector, a first end of the conductive sheet is connected to a first end of the second conductive wire, and a second end of the second conductive wire is connected to the motor, a second end of the elastic sheet is connected to a second end of the conductive sheet under pressure, and the second end of the elastic sheet is separated from the second end of the conductive sheet without pressure.

3. The fan of claim 2, wherein the elastic sheet and the conductive sheet are made of electrically conductive material.

* * * * *